US007779501B2

(12) United States Patent
Lacotta et al.

(10) Patent No.: US 7,779,501 B2
(45) Date of Patent: Aug. 24, 2010

(54) MOP HAVING SCRUBBING AREA

(75) Inventors: Paul Lacotta, Tenafly, NJ (US); William Fiebel, West Orange, NJ (US); John Moldauer, East Meadow, NY (US); Bernard Bensussan, Monroe, CT (US); Ron Callanan, Seymour, CT (US)

(73) Assignee: Unger Marketing International, LLC, Bridgeport, CT (US)

( * ) Notice: Subject to any disclaimer, the term of this patent is extended or adjusted under 35 U.S.C. 154(b) by 1294 days.

(21) Appl. No.: 11/215,872

(22) Filed: Aug. 31, 2005

(65) Prior Publication Data

US 2006/0070196 A1 Apr. 6, 2006

Related U.S. Application Data

(60) Provisional application No. 60/606,235, filed on Sep. 1, 2004.

(51) Int. Cl.
*A47L 13/12* (2006.01)

(52) U.S. Cl. ..... 15/118; 15/115; 15/228; 15/231

(58) Field of Classification Search ..... 15/118, 15/228, 115, 231, 119.2, 244
See application file for complete search history.

(56) References Cited

U.S. PATENT DOCUMENTS

| | | | | |
|---|---|---|---|---|
| 2,740,146 | A * | 4/1956 | Vaughn | 15/119.2 |
| 3,147,502 | A * | 9/1964 | Richards | 15/118 |
| 3,199,136 | A | 8/1965 | George | 15/231 |
| 3,656,202 | A | 4/1972 | Paton | 15/121 |
| 4,852,210 | A | 8/1989 | Krajicek | 15/228 |
| 4,947,504 | A * | 8/1990 | Ostwald | 15/119.2 |
| 4,991,250 | A | 2/1991 | Young | 15/228 |
| 5,625,918 | A | 5/1997 | Kieson et al. | 15/119.2 |
| 7,257,853 | B2 * | 8/2007 | Boyer et al. | 15/119.2 |
| 7,469,441 | B2 * | 12/2008 | Hirse | 15/119.2 |
| 2004/0231700 | A1 | 11/2004 | Bell et al. | 134/6 |
| 2006/0018706 | A1 * | 1/2006 | Bensussan et al. | 403/122 |
| 2006/0070196 | A1 * | 4/2006 | Lacotta et al. | 15/118 |

FOREIGN PATENT DOCUMENTS

| | | |
|---|---|---|
| CN | 2610834 | 4/2003 |
| EP | 0 370 697 | 11/1989 |
| EP | 0 370 698 | 11/1989 |
| EP | 1 188 406 | 9/2001 |
| GB | 1 286 784 | 8/1972 |
| WO | WO 97/40736 | 11/1997 |

OTHER PUBLICATIONS

International Search Areport for International Application No. PCT/US2005/30871 dated Jul. 20, 2006.
Russian Office Action dated May 16, 2009 from Russian Patent Application No. 2007111931/12(012960)- with English translation.
New Zealand Office Action dated May 7, 2009 from New Zealand Patent Application No. 553703.
Chinese Office Action dated Apr. 14, 2009 from Chinese Patent Application No. 2005800339753- with English translation.

* cited by examiner

*Primary Examiner*—Lee D Wilson
(74) *Attorney, Agent, or Firm*—Ohlandt, Greeley, Ruggiero & Perle, L.L.P.

(57) ABSTRACT

A mop for cleaning a surface is provided. The mop includes a base and a scrubbing area connected to the base by a living hinge so that the scrubbing area can be deflected towards the surface upon application of a scrubbing force.

35 Claims, 4 Drawing Sheets

MOP HAVING SCRUBBING AREA

CROSS REFERENCE TO RELATED APPLICATIONS

This application claims the benefit of U.S. Provisional Application Ser. No. 60/606,235, filed on Sep. 1, 2004 the contents of which are incorporated by reference herein.

BACKGROUND OF THE INVENTION

1. Field of the Invention

The present disclosure relates to mops. More particularly, the present disclosure relates to a mop having a scrubbing area.

2. Description of Related Art

Many different types of mops have been developed for cleaning floors. Many such mops can include one or more devices that allow the mop to scrub a particular area of the floor, such as a scuffmark, a sticky spot, and the like.

For example, sponge mops are generally known. Some sponge mops include a flat rectangular sponge or sponge like material mounted on a base plate holder, which has a handle or pole extending therefrom. In use, the sponge's mop face can be moved across the floor via the pole. Some sponge mops also include a scrub strip generally made of a textured material attached to a side of the sponge or base plate. The scrub strip allows the user to perform a more abrasive action on a surface. In order to use the scrub strip, the user must turn the mop so that the scrub strip is directed towards the floor. After the desired scrubbing action is completed, any freed debris will need to be mopped up, so the user must return the mop to its original position. Thus, such prior devices have proven less efficient than desired as they can only perform one action at a time, namely a scrubbing action or a mopping action. In addition, the pressure applied to the pole during scrubbing is in different direction than the pressure applied during normal mopping. Thus, the pole must be designed to withstand pressures or forces being applied in differing directions, which can increase the cost of the pole.

Mops that utilize a disposable cleaning sheet or pad, such as a woven or non-woven sheet, for cleaning are also generally known. These mops can be used wet or dry and are commonly known in the art as "dust mops". Many dust mops removably secure the cleaning sheet to a generally planar mop head. The mop head is pivotally secured to an extension pole, allowing the user to move the cleaning sheet over a flat surface using a traditional mopping action. Such a dust mop is described in U.S. Pat. No. 4,225,998 to Theilen. Unfortunately, these dust mops have not provided scrubbing means, which can limit their utility.

Accordingly, there is a continuing need in the art for mops that overcome and/or mitigate one or more of the aforementioned drawbacks and deficiencies to improve the utility, functionality, efficiency, and/or cost of prior cleaning devices.

BRIEF SUMMARY OF THE INVENTION

It is an object of the present disclosure to provide a mop having a scrubbing area.

It is another object of the present disclosure to provide a mop having a base, which allows a portion of the mop to provide a scrubbing action, while other portions perform a mopping action.

It is another object of the present disclosure to provide a mop capable of exerting a localized area of increased pressure to a surface being cleaned.

A mop for cleaning a surface is provided. The mop includes a base and a scrubbing area connected to the base by a living hinge so that the scrubbing area can be deflected towards the surface upon application of a scrubbing force.

A mop for cleaning a surface having a rigid base section and a flexible base section secured to the rigid base section is also provided. The mop includes a scrubbing area in the flexible base section opposite the rigid base section and a living hinge in the rigid base section above the scrubbing area. In this manner, a scrubbing force applied to the rigid base section deflects the rigid base section to move the scrubbing area toward the surface.

In some embodiments, the mop having the rigid base section and the flexible base section secured to the rigid base section includes a hinge member, a scrubbing area, and a living hinge. The hinge member is on the rigid base section opposite the flexible base section. The scrubbing area is in the flexible base section below the hinge member. The living hinge is defined in the rigid base section about the hinge member so that a scrubbing force applied to the hinge member deflects the rigid base section to move the scrubbing area toward the surface.

The above-described and other features and advantages of the present disclosure will be appreciated and understood by those skilled in the art from the following detailed description, drawings, and appended claims.

DETAILED DESCRIPTION OF THE INVENTION

Figure 1:
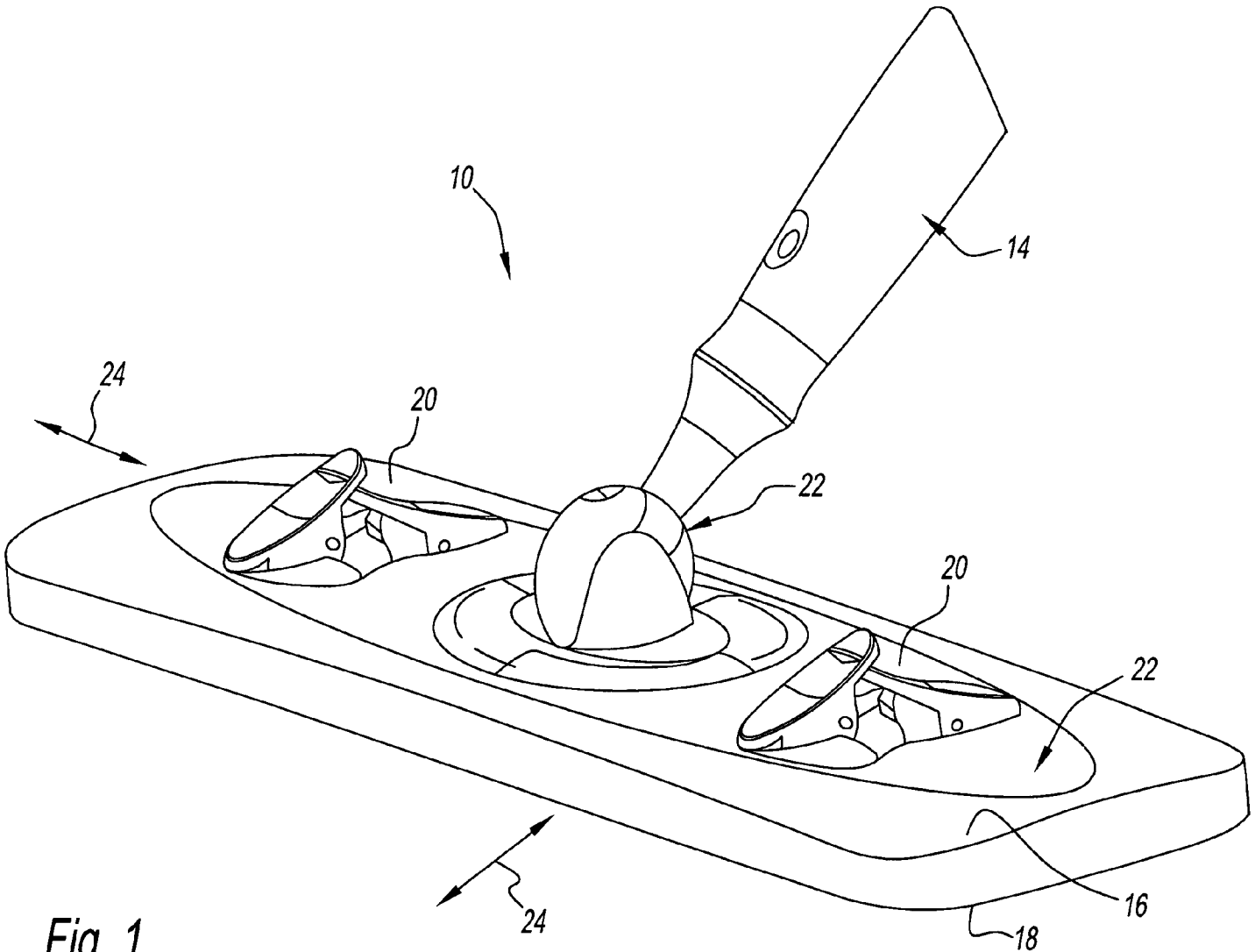
FIG. 1 is a perspective view of an exemplary embodiment of a mop according to the present disclosure.

Referring to the drawings and in particular to FIG. 1, an exemplary embodiment of a mop according to the present disclosure is generally referred to by reference number 10. Mop 10 includes a base 12 and a handle or an extension pole 14, hereinafter referred to as a "pole" or an "extension pole". Mop 10 is illustrated as a wet or dry dust mop having a generally rectangular base 12.

In the illustrated embodiment, base 12 has a top surface 16, a bottom or cleaning surface 18, and one or more attachment members 20 for removably securing a wet or dry dust cleaning sheet (not shown) across the cleaning surface 18. By way of example, mop 10 can find use with disposable cleaning sheets, such as those commercially available from Proctor and Gamble under the "Swiffer" trade name. In addition, mop 10 can find use with re-useable cleaning sheets.

Extension pole 14 can be secured to top surface 16 by a hinge member 22, which allows the pole and base to move with respect to one another in one or more directions. For example, hinge member 22 can be a dual axis hinge as described in commonly owned U.S. patent application Ser. No. 10/896,246, filed on Jul. 21, 2004, the contents of which are incorporated by reference herein.

In use, bottom surface 18 is pushed over an area in one or more cleaning directions 24 in response to mopping forces applied to pole 14. As mop 10 is moved, the cleaning sheet picks up debris from the floor. Once the cleaning sheet is full of debris, the sheet can be removed from base 12 via attachment members 20 and replaced with a clean sheet.

Figure 2:
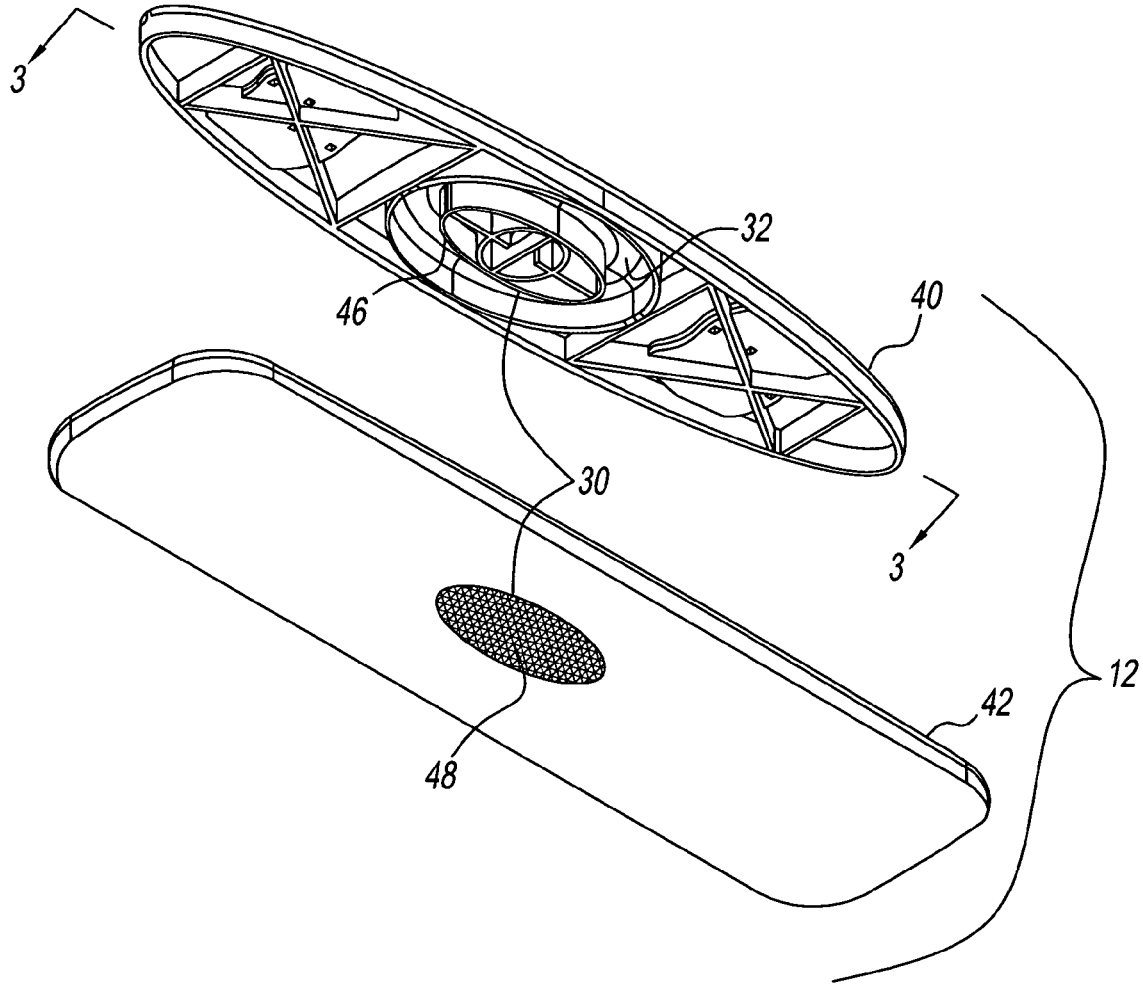
FIG. 2 is a partially exploded bottom view of the mop of FIG. 1 in a normal use position having various components omitted for clarity.
Figure 2A:
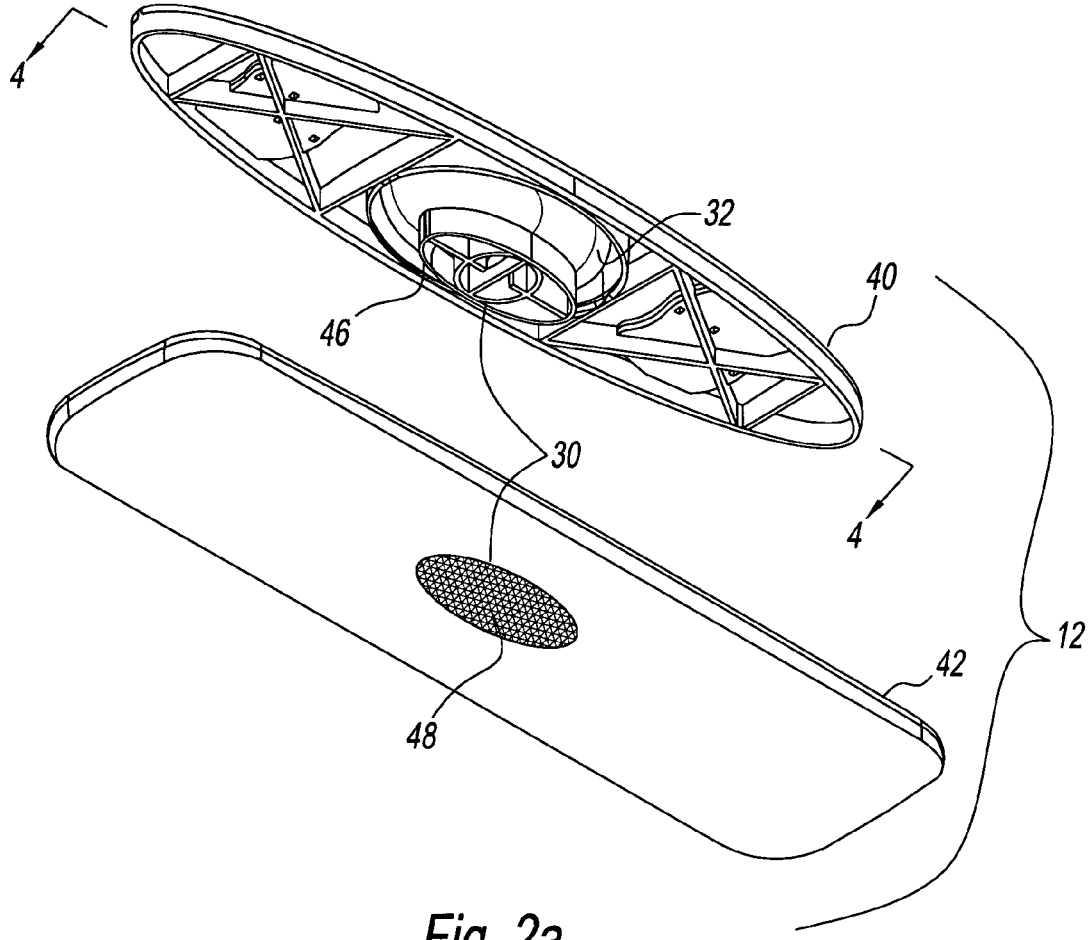
FIG. 2*a* is a partially exploded bottom view of the mop of FIG. 1 in a scrubbing position having various components omitted for clarity.
Figure 3:
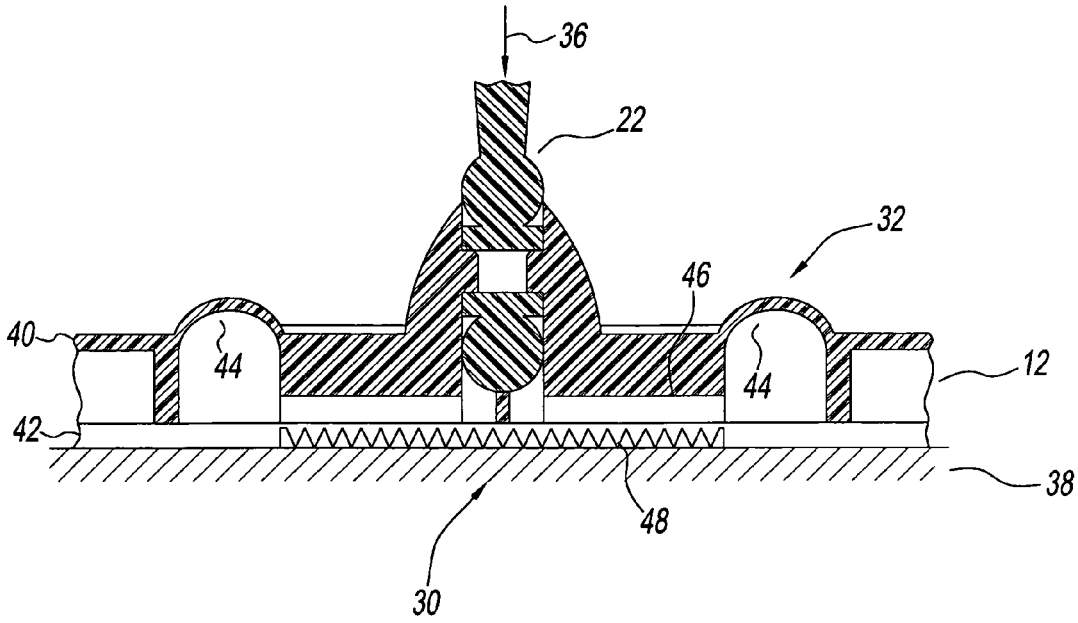
FIG. 3 is a first sectional view of the mop of FIG. 2 taken along lines 4-4 in a normal use position.
Figure 4:
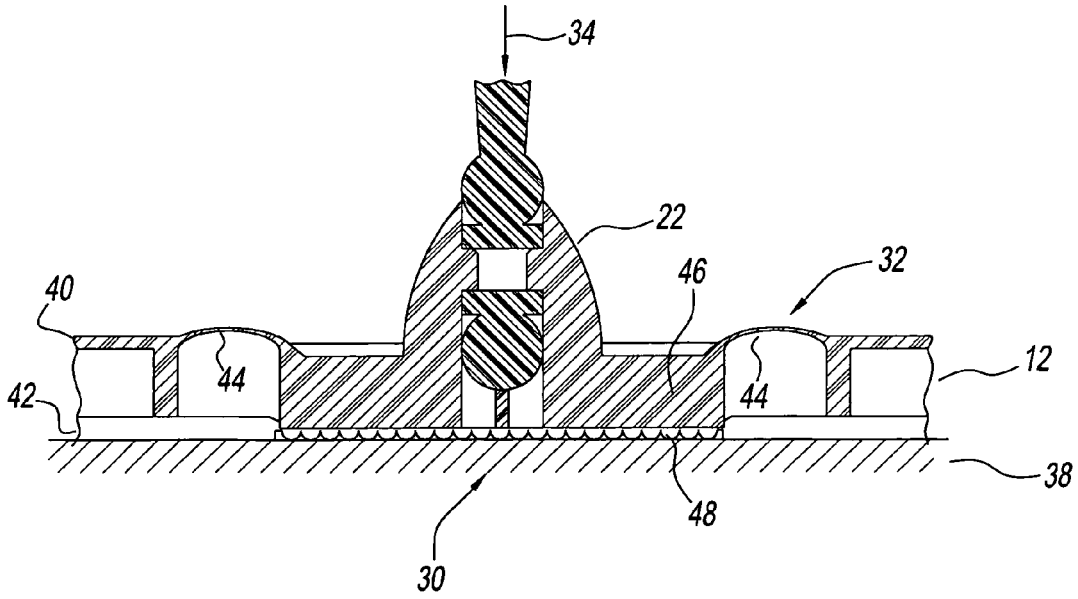
FIG. 4 is a second sectional view of the mop of FIG. 3 taken along lines 5-5 in a scrubbing position.

Advantageously, base 12 of mop 10 includes a scrubbing area 30 and a living hinge 32, which are described in detail with simultaneous reference to FIGS. 2 through 4.

Living hinge 32 allows a scrubbing force 34 applied to base 12 via pole 14 to deflect scrubbing area 30 towards the floor 38 as seen in FIG. 4. However, during normal use only a mopping force 36 is applied to base 12 via pole 14, where the mopping force is not sufficient to deflect scrubbing area 30 towards the floor 38 as seen in FIG. 3.

Thus, application of scrubbing force 34 on pole 14 deflects a portion of the base towards the surface being cleaned. The localized pressure increase that is available from mop 10 when applying the scrubbing force 34 can be used to scrub the floor with a portion with of mop 10, while also mopping the floor with other portions of the mop. In addition, base 12 allows the force applied to pole 14 during scrubbing (i.e., "scrubbing force 34") to be in the generally the same direction as the force applied to the pole during normal mopping (i.e., "mopping force 36"), which can decrease the need for poles that can withstand forces applied in differing directions.

Referring to FIG. 2, base 12 includes an upper section 40 and a lower section 42. Upper section 40 is a substantially rigid member, which can be formed of, for example, molded plastic or metal. Lower section 42 can be a substantially flexible member, such as, but not limited to, an open-celled foam, a closed-celled foam, or combinations thereof. By way of example only, lower section 42 can be as shown and described in U.S. Provisional Application Ser. No. 60/606,234, filed Sep. 1, 2004, the contents of which are incorporated by reference herein.

Living hinge 32 is positioned in base 12 around hinge member 22, namely at the location the where pole 14 is attached to the base. In this manner, living hinge 32 allows scrubbing force 34 applied to base 12 from pole 14 to move scrubbing area 30 against floor 38. Living hinge 32 can be, for example, one or more thinned sections 44 of upper section 40. In the illustrated embodiment, living hinge 32 is shown having a single continuous thinned section 44. Of course, it is contemplated by the present disclosure for living hinge 32 to have multiple thinned sections 44.

It should also be recognized that living hinge 32 is described herein by way of example as one or more thinned sections 44. Of course, it is contemplated for base 12 to include other structures that provide the base with living hinge 32. For example, upper section 40 can include a number of holes or openings (not shown) defined about hinge 22. Here, the holes can provide sufficient weakness to upper section 40 around the hinge so that scrubbing force 34 can deflect the base as desired.

Scrubbing area 30 is provided on lower section 42 below hinge member 22. In this manner, deflection of living hinge 32 moves scrubbing area 30 towards floor 38. Advantageously, the deflection of living hinge 32 locally increases the pressure of scrubbing area 30 on floor 38.

In some embodiments, upper section 40 can include one or more structural ribs 46 positioned over scrubbing area 30. Here, deflection of living hinge 32 moves ribs 46 towards floor 38, which in turn moves scrubbing area 30 towards the floor. In other embodiments, lower section 42 can include a number of scrubbing protrusions 48 at scrubbing area 30. Here, deflection of the scrubbing area 30 against floor 38 presses scrubbing protrusions 48 against the floor to assist in the scrubbing action of mop 10.

It should also be recognized that mop 10 is illustrated and described herein as a dust mop in use with a cleaning sheet. However, it is contemplated by the present disclosure for mop 10 to find equal utility with sponge mops. Here, lower section 42 can be a sponge that is removably attachable to upper section. In this embodiment, the sponge lower section can includes a scrub strip, as is known in the art, generally made of a textured material attached to the sponge in the area of scrubbing protrusions 48 discussed above.

It should also be noted that the terms "first", "second", "third", "upper", "lower", "inner", "outer", and the like may be used herein to modify various elements. These modifiers do not imply a spatial, sequential, or hierarchical order to the modified elements unless specifically stated.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof. Therefore, it is intended that the present disclosure not be limited to the particular embodiment(s) disclosed as the best mode contemplated, but that the disclosure will include all embodiments falling within the scope of the appended claims.

The invention claimed is:

1. A mop for cleaning a surface, comprising:

a base;

an extension handle connected to a portion of said base; and a scrubbing area connected to said portion of said base by a living hinge so that said scrubbing area is elastically deflected towards the surface upon application of a scrubbing force to the extension handle.

2. The mop as in claim 1, further comprising one or more attachment members for removably securing a wet or dry dust cleaning sheet to said base.

3. The mop as in claim 1, further comprising a hinge member, said hinge member securing said extension pole to said portion of said base.

4. A mop for cleaning a surface, comprising:

a rigid base section having an inner area and an outer area;

a flexible base section secured to said rigid base section;

a scrubbing area defined in said flexible base section below said inner area of said rigid base section; and a living hinge defined in said rigid base section between said inner and outer areas so that a scrubbing force applied to said inner area elastically deflects said inner area with respect to said outer area to move said scrubbing area toward the surface.

5. The mop as in claim 4, wherein said living hinge comprises one or more thinned sections defined in said rigid base section.

6. The mop as in claim 4, wherein said rigid base section comprises one or more attachment members for removably securing a wet or dry dust cleaning sheet over said flexible base section.

7. The mop as in claim 4, wherein said scrubbing area comprises a plurality of scrubbing protrusions.

8. The mop as in claim 4, wherein said living hinge comprises one or more openings defined through said rigid base section.

9. The mop as in claim 4, wherein said living hinge comprises one or more thinned sections defined in said rigid base section and one or more openings defined through said rigid base section.

10. A mop for cleaning a surface, comprising:

a rigid base section having an inner area and an outer area;

a flexible base section secured to said rigid base section;

a hinge member on said inner area of said rigid base section;

a scrubbing area defined in said flexible base section below said inner area; and a living hinge defined in said rigid base section about said inner area so that a scrubbing force applied to said hinge member elastically deflects said inner area of said rigid base section with respect to said outer area to move said scrubbing area toward the surface.

11. The mop as in claim 10, wherein said living hinge comprises one or more thinned sections of said rigid base section.

12. The mop as in claim 10, wherein said living hinge comprises a plurality of openings defined through said rigid base section.

13. The mop as in claim 10, wherein said flexible base section comprises a material selected from the group consisting of an open-celled foam, a closed-celled foam, and any combinations thereof.

14. The mop as in claim 10, wherein said rigid base section comprises one or more attachment members for removably securing a wet or dry dust cleaning sheet over said flexible base section.

15. The mop as in claim 10, further comprising an extension pole secured to said hinge member.

16. The mop as in claim 10, wherein said scrubbing area comprises a plurality of scrubbing protrusions.

17. The mop as in claim 10, wherein said flexible base section comprises a sponge that is removably secured to said rigid base section.

18. The mop as in claim 17, wherein said scrubbing area comprises a scrub strip of said sponge.

19. A mop for cleaning a surface, comprising:

an upper section having an outer area, an inner area, and a deflection area elastically securing said inner and outer areas to one another; and a lower section having a scrubbing member, said lower section being secured to said upper section so that said scrubbing member is below said inner area of said upper section, wherein said deflection area is deflected upon application of a scrubbing force to said inner area to cause said inner area to move with respect to said outer area so that said scrubbing member moves towards the surface.

20. The mop as in claim 19, further comprising an extension pole secured to said inner area.

21. The mop as in claim 20, further comprising a hinge member securing said extension pole to said inner area of said upper section.

22. The mop as in claim 20, wherein application of a scrubbing force to said inner area via said extension pole is sufficient to deflect said deflection area towards the surface.

23. The mop as in claim 20, wherein application of a mopping force to said inner area via said extension pole is not sufficient to deflect said deflection area towards the surface.

24. The mop as in claim 23, wherein said scrubbing force has a direction that is generally the same as a direction of said mopping force.

25. The mop as in claim 19, wherein said upper section further comprises one or more attachment members on an upper surface thereof, said one or more attachment members being configured to removably secure a cleaning sheet over said lower section.

26. The mop as in claim 19, wherein said lower section comprises a material selected from the group consisting of an open-celled foam, a closed-celled foam, and any combinations thereof.

27. The mop as in claim 19, wherein said upper section comprises a rigid base section and said deflection area comprises a living hinge.

28. The mop as in claim 27, wherein said living hinge comprises one or more thinned sections defined in said rigid base section.

29. The mop as in claim 27, wherein said living hinge comprises a plurality of openings defined through said rigid base section.

30. The mop as in claim 19, wherein said scrubbing area comprises a plurality of scrubbing protrusions.

31. The mop as in claim 19, wherein said lower section comprises a sponge that is removably secured to said upper section.

32. The mop as in claim 31, wherein said scrubbing area comprises a scrub strip of said sponge.

33. A mop for cleaning a surface, comprising:

a rigid base containing an inner section and an outer section;

a scrubbing area connected to said inner section; and means for elastically flexing said inner section with respect to said outer section so that said scrubbing area moves toward the surface upon application of a force to said inner section.

34. A mop for cleaning a surface, comprising:

a rigid base section having an outer area elastically connected to an inner area;

a flexible base section secured to said rigid base section, said flexible base section having a scrubbing area below said inner area, wherein said inner and outer areas are configured to move elastically relative to one another to exert a localized area of increased pressure to the surface at said scrubbing area.

35. A mop for cleaning a surface, comprising:

a rigid upper section having an outer area and an inner area connected by one or more thinned sections;

an extension pole secured to said inner area; and a scrubbing member below said inner area of said rigid upper section, wherein said one or more thinned sections are configured to cause said inner area to move with respect to said outer area so that said scrubbing member moves towards the surface upon application of a scrubbing force to said extension pole.

* * * * *